US007322137B2

(12) United States Patent
Machala

(10) Patent No.: US 7,322,137 B2
(45) Date of Patent: Jan. 29, 2008

(54) DYNAMIC DISPLAY AIR INFLATABLE DEVICE

(75) Inventor: William Machala, Smithfield, RI (US)

(73) Assignee: Chrisha Creations, Ltd. RI (US)

( * ) Notice: Subject to any disclaimer, the term of this patent is extended or adjusted under 35 U.S.C. 154(b) by 41 days.

(21) Appl. No.: 11/127,490

(22) Filed: May 11, 2005

(65) Prior Publication Data

US 2006/0107564 A1 May 25, 2006

Related U.S. Application Data

(60) Provisional application No. 60/630,530, filed on Nov. 23, 2004.

(51) Int. Cl.
*G09F 19/00* (2006.01)

(52) U.S. Cl. ..... 40/439; 40/441; 40/410; 40/412; 40/422; 446/221; 446/226

(58) Field of Classification Search ..... 40/410, 40/439, 412, 422; 446/221, 178, 179, 220, 446/226

See application file for complete search history.

(56) References Cited

U.S. PATENT DOCUMENTS 2,543,606 A * 2/1951 Randolph et al. ..... 40/410
2,621,042 A * 12/1952 Stein et al. ..... 273/144 R
2,748,256 A 5/1956 Morgan
3,066,439 A 12/1962 Lemelson
3,363,350 A 1/1968 Moran
3,672,083 A 6/1972 Moran
3,745,677 A 7/1973 Moran
3,835,308 A * 9/1974 Reese ..... 362/362

(Continued)

FOREIGN PATENT DOCUMENTS

DE 203 17200 U1 3/2004

(Continued)

OTHER PUBLICATIONS

Blowing deals is up their alley; Scherba's big inflatables Super Bowl Bound. (Inflatable Images, David and Bob Scherba); Suttle, Scott; Crain's Cleveland Business, v22, n4, p. 3; Jan. 22, 2001; ISSN: 0197-2375.

(Continued)

*Primary Examiner*—Jack W. Lavinder
(74) *Attorney, Agent, or Firm*—Morgan & Finnegan, LLP

(57) ABSTRACT

The invention is directed to an inflatable display that has a plurality of inflation modules. The modules are inflated by a fan element. More specifically, a first inflation module is formed from a permeable material and configured to represent a predetermined shape or design when inflated, such as a snowman, Santa Claus, Easter Bunny, Uncle Sam or another seasonal or holiday character. The first inflation module is surrounded by a non-permeable material creating an enclosure around the first inflation module and forming a second inflation module. The first inflation module is formed with at least one exhaust port in its base, which has two purposes. First, the exhaust port acts to inflate the second inflation module. Second, the exhaust port in the first inflation module acts in coordination with a mesh screen formed in the surface of the second inflation module to create an airflow that agitates a plurality of "snowlike" particles within the second module, or particles corresponding to any holiday and/or seasonal display.

25 Claims, 4 Drawing Sheets

U.S. PATENT DOCUMENTS 3,999,750 A * 12/1976 Perkins ..... 472/65
4,028,830 A * 6/1977 Ottinger ..... 40/410
4,076,234 A * 2/1978 Burnbaum ..... 472/65
4,179,832 A * 12/1979 Lemelson ..... 40/540
4,190,312 A * 2/1980 Bailey ..... 40/431
4,641,445 A * 2/1987 Rossi ..... 40/410
4,759,737 A * 7/1988 Ferenczi ..... 446/183
4,776,121 A 10/1988 Vicino
4,817,311 A * 4/1989 Ong S. T. ..... 40/410
4,932,169 A * 6/1990 Charbonneau ..... 52/2.18
4,962,922 A * 10/1990 Chu ..... 472/65
4,995,186 A 2/1991 Collie
5,092,065 A * 3/1992 Teng ..... 40/410
5,098,084 A * 3/1992 Culver ..... 472/65
5,110,636 A * 5/1992 Hou ..... 428/11
5,125,177 A * 6/1992 Colting ..... 40/610
5,131,175 A * 7/1992 Liu ..... 40/410
5,200,239 A * 4/1993 Chen ..... 428/13
5,215,492 A 6/1993 Kubiatowicz
5,291,674 A * 3/1994 Torrence ..... 40/410
5,313,727 A * 5/1994 Murray, Jr. ..... 40/410
5,335,436 A * 8/1994 Gurr ..... 40/412
5,412,888 A * 5/1995 Rickuss et al. ..... 40/410
5,442,869 A * 8/1995 McDarren et al. ..... 40/406
5,451,179 A * 9/1995 LaRoi et al. ..... 446/224
5,467,543 A * 11/1995 Fink et al. ..... 40/538
5,471,797 A * 12/1995 Murphy ..... 52/2.17
5,491,916 A * 2/1996 Ingram et al. ..... 40/410
5,502,908 A * 4/1996 Powell et al. ..... 40/410
5,632,419 A * 5/1997 Pickens ..... 222/189.05
5,666,750 A * 9/1997 Segan et al. ..... 40/410
5,710,543 A 1/1998 Moore
5,711,099 A * 1/1998 Nesbit et al. ..... 40/406
5,778,581 A 7/1998 Bailey
5,816,884 A * 10/1998 Chang ..... 446/267
5,857,277 A * 1/1999 Mayze ..... 40/410
5,864,976 A * 2/1999 Yang ..... 40/410
5,979,091 A * 11/1999 TenBrink ..... 40/410
6,012,826 A 1/2000 Chabert
6,048,591 A * 4/2000 Zwiebel ..... 428/12
6,052,930 A * 4/2000 Hermanson et al. ..... 40/410
6,161,317 A * 12/2000 Wang ..... 40/406
6,186,857 B1 * 2/2001 Gazit et al. ..... 446/226
6,205,689 B1 * 3/2001 TenBrink ..... 40/410
6,276,815 B1 8/2001 Wu
6,282,820 B1 * 9/2001 White et al. ..... 40/410
6,322,230 B1 11/2001 Medici
6,345,457 B1 * 2/2002 Bradley ..... 40/410
6,357,151 B1 * 3/2002 Yuen ..... 40/406
6,385,880 B1 * 5/2002 Naragon ..... 40/406
6,415,535 B1 * 7/2002 White et al. ..... 40/410
6,431,729 B1 8/2002 Chen
6,461,087 B2 * 10/2002 Lin ..... 406/106
6,527,418 B1 3/2003 Scherba
6,550,169 B1 * 4/2003 Sena et al. ..... 40/410
6,564,483 B1 * 5/2003 Hsu ..... 40/409
6,568,107 B2 * 5/2003 Yuen ..... 40/406
6,572,847 B2 6/2003 Liu
6,588,130 B1 * 7/2003 Yang ..... 40/410
6,591,525 B1 * 7/2003 Liu ..... 40/410
6,644,843 B2 * 11/2003 Chin-Cheng ..... 362/97
6,696,116 B2 * 2/2004 Bigman ..... 428/18
6,722,064 B2 * 4/2004 Knapp et al. ..... 40/410
6,764,201 B2 * 7/2004 Chi-Cheng ..... 362/352
6,880,274 B2 * 4/2005 Liu ..... 40/410
6,895,703 B2 * 5/2005 Tien ..... 40/410
7,040,050 B2 * 5/2006 Skinner ..... 40/410
2001/0046572 A1 * 11/2001 Bigman ..... 428/18
2002/0000055 A1 * 1/2002 Augsburger ..... 40/410
2002/0089854 A1 7/2002 Liu
2002/0095831 A1 7/2002 Tsai
2002/0174578 A1 * 11/2002 Ross ..... 40/409
2002/0184801 A1 * 12/2002 Naragon ..... 40/406
2003/0041490 A1 * 3/2003 Dott et al. ..... 40/410
2003/0140534 A1 * 7/2003 Lo ..... 40/410
2003/0177677 A1 * 9/2003 Acosta, Sr. ..... 40/410
2003/0196357 A1 * 10/2003 Knapp et al. ..... 40/410
2004/0045198 A1 * 3/2004 Liu ..... 40/410
2004/0244243 A1 * 12/2004 Tien ..... 40/410
2005/0039358 A1 * 2/2005 Rust ..... 40/410
2005/0120602 A1 * 6/2005 Skinner ..... 40/410
2005/0190556 A1 9/2005 Machala
2005/0250411 A1 * 11/2005 Moomaw ..... 446/221
2006/0107564 A1 * 5/2006 Machala ..... 40/410
2006/0111011 A1 * 5/2006 Wang ..... 446/220

FOREIGN PATENT DOCUMENTS

EP WO 2005/107422 A 11/2005

OTHER PUBLICATIONS

Globalock Corp.—dba American Inflatables—Crosses Into the New Millennium. Business Wire, p0149; Jan. 3, 2000.
Air time: Inflatables Have Designs on Promotional markets; Promo, v0, n0, p. 61; Sep. 1994; ISSN: 1047-1707.
Reaching New Heights. (Air Dimensional Design Inc. makes inflatable marketing tools); Greenberg, David; Los Angeles Business Journal, v23, n18, p. 19; Apr. 13, 2001.
Communication from the European Patent Office Pursuant to Article 96(2)EPC (mailed Nov. 12, 2006).
Communication dated Mar. 31, 2006 with Extended European Search Report.

* cited by examiner 35
25
30
20
33
33
33

DYNAMIC DISPLAY AIR INFLATABLE DEVICE

CROSS-REFERENCE TO RELATED APPLICATION

This application claims priority from provisional U.S. Patent Application Ser. No. 60/630,530 entitled DYNAMIC DISPLAY FORMED WITHIN AN INFLATABLE filed in the name of William Machala on Nov. 23, 2004, the entirety of which is incorporated by reference herein.

FIELD OF THE INVENTION

The apparatus and method of the present invention relate to dynamic inflatable air displays that may be formed within a transparent enclosure and inflated through the use of a fan or other inflation device.

BACKGROUND OF THE INVENTION

Inflatable displays have become increasingly popular in recent years. These types of displays have a wide range of application, shape and size, including, but not limited to, figures for holiday and seasonal decoration, marketing, advertising, entertainment, and event attraction. The inflatable displays are made from a permeable fabric that allows air to pass through the fabric at approximately the same rate as the air being blown into the inflatable display. The process of continuously blowing air being supplied from a fan or other inflation device occurring at substantially the same rate as air escaping the fabric allows the display to maintain a three-dimensional shape without the use of an internal or external frame or structure. These are known in the industry as "cold-air" inflatable displays.

Typically, the cold-air inflatable display is a static figure formed from an inflation module which represents an individual figure when inflated. For example, a consumer may decide to decorate their house with a jack-o-lantern inflatable display for the Halloween season, a snowman inflatable display for the holiday season, or an Uncle Sam inflatable display for Independence Day. However, the inflatable display is generally a static element that is representative of a holiday or seasonal display. As such, typically, a figure is inflated to form a static display. There is no present apparatus or method utilizing a fan element or other inflation element to inflate an inflation module provided within an enclosure, wherein the fan element, the enclosure and the inflation module provide a dynamic display, as described herein.

SUMMARY OF THE INVENTION

The invention is directed to an inflatable display that has a first inflation module formed within a transparent enclosure. The inflation module is inflated by a fan element. More specifically, a first inflation module is formed from a permeable material and configured to represent a predetermined shape or design when inflated, such as a snowman, Santa Claus, Easter Bunny, Uncle Sam or any other type of holiday or seasonal display scene. The first inflation module is surrounded by a non-permeable material creating an enclosure forming a second inflation module.

According to an embodiment of the invention, a first inflation module is inflated in the shape of a snowman or other holiday or seasonal figure. The first inflation module is formed with at least one exhaust port in its base, which has two purposes. First, the exhaust port acts to inflate the second inflation module. Second, the exhaust port in the first inflation module acts in coordination with a mesh screen formed in the surface of the second inflation module to create an air flow within the enclosure. The second inflation module includes a plurality of small particles that are formed to look like snow or any other dynamic particles or objects appropriate for a holiday or seasonal display scene. Furthermore, the particles are created from a very light material and are carried by the air flows within the enclosure. Accordingly, an observer looking at the invention would visualize a snowing environment surrounding a snowman.

It will be appreciated by those skilled in the art that the foregoing brief description and the following detailed description are exemplary and explanatory of this invention, but are not intended to be restrictive thereof or limiting of the advantages which can be achieved by this invention. Thus, the accompanying drawings, referred to herein and constituting a part hereof, illustrate preferred embodiments of this invention, and, together with the detailed description, serve to explain the principles of this invention.

BRIEF DESCRIPTION OF THE DRAWINGS

The features and advantages of the present invention, both as to its structure and operation, will be apparent from the following detailed description, especially when taken in conjunction with the accompanying drawings, wherein.

DETAILED DESCRIPTION OF THE INVENTION

Figure 2:
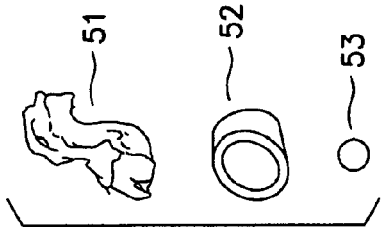
FIG. 2 illustrates three exemplary embodiments of polystyrene particles for use with the present invention.

The apparatus and method of the present invention will now be discussed with reference to FIGS. 1, 2, 3A-3E, 4 and 5. As first illustrated in FIG. 1, the invention is directed to an inflatable display unit 10. More specifically, according to an embodiment of the invention, inflatable display unit 10 will be discussed herein with regard to its component pieces that include first inflation module 30, enclosure 20 (second inflation module), fan element 35, lighting apparatus 40, and "snowflake" particles 50. An object of the invention is to implement first and second inflation modules, wherein the first is disposed within the second module. Furthermore, the second module is formed from a clear plastic material creating an enclosed operational environment. According to the invention, the air used to inflate the first and second modules is also used to agitate a plurality of polystyrene particles within the enclosure. Accordingly, an observer viewing the inflatable display would get the impression that it is snowing within the enclosure.

As illustrated according to one embodiment of the invention, first inflation module 30 is shown in the figures as a snowman. It is to be understood that while the figures illustrate a snowman, first inflation module 30 may be configured in any character, shape or size, depending on the specific need and purpose of the display. By way of example only, alternate embodiments of the invention may include such characters as Santa and/or Mrs. Clause, a reindeer, an Easter Bunny, Uncle Sam, or any type of seasonal or holiday character. Furthermore, it is to be understood that any number of inflation modules may be utilized to create the display and that any number or variety of inner-modules may be configured within one or more outer modules. Any number of fans corresponding to the number of inflation modules may also be utilized. In alternative embodiments, the inflatable device may include an inflatable city skyline or other tourist attraction that would parallel the typical liquid filled "snow globes" that are often sold to tourists.

First inflation module 30 is preferably made from a permeable fabric that allows air to escape at approximately the same rate as air being blown into the inflatable display 10 by fan element 35. Inflatable display 10 is held in position by a securing mechanism, such as, a ballast 55 situated at the bottom of enclosure 20 or a tether that fastens to either the ground or another structure and is secured to said inflatable display 10 by securing devices, such as a securing ring attached to inflatable display 10.

The inflatable display may include an interior lighting arrangement 40 that includes one or more light bulbs 41 secured to a power cord 43 and disposed within first inflation module 30. Protective covers 44 are secured around each light bulb 41 to protect the permeable fabric of first inflation module 30 from heat produced from each light bulb 41. Interior lighting assembly 40 is attached to fan assembly 35 through an electrical connector 45 on the bottom end of a power cord 46 that mates with fan assembly 35. Advantageously, if an operator does not want to illuminate the interior of the display, the operator may simply detach the electrical connector 45 from the fan assembly element to remove power from interior lighting arrangement 40, without necessarily removing lights 41 from the interior of the display.

Figure 1:
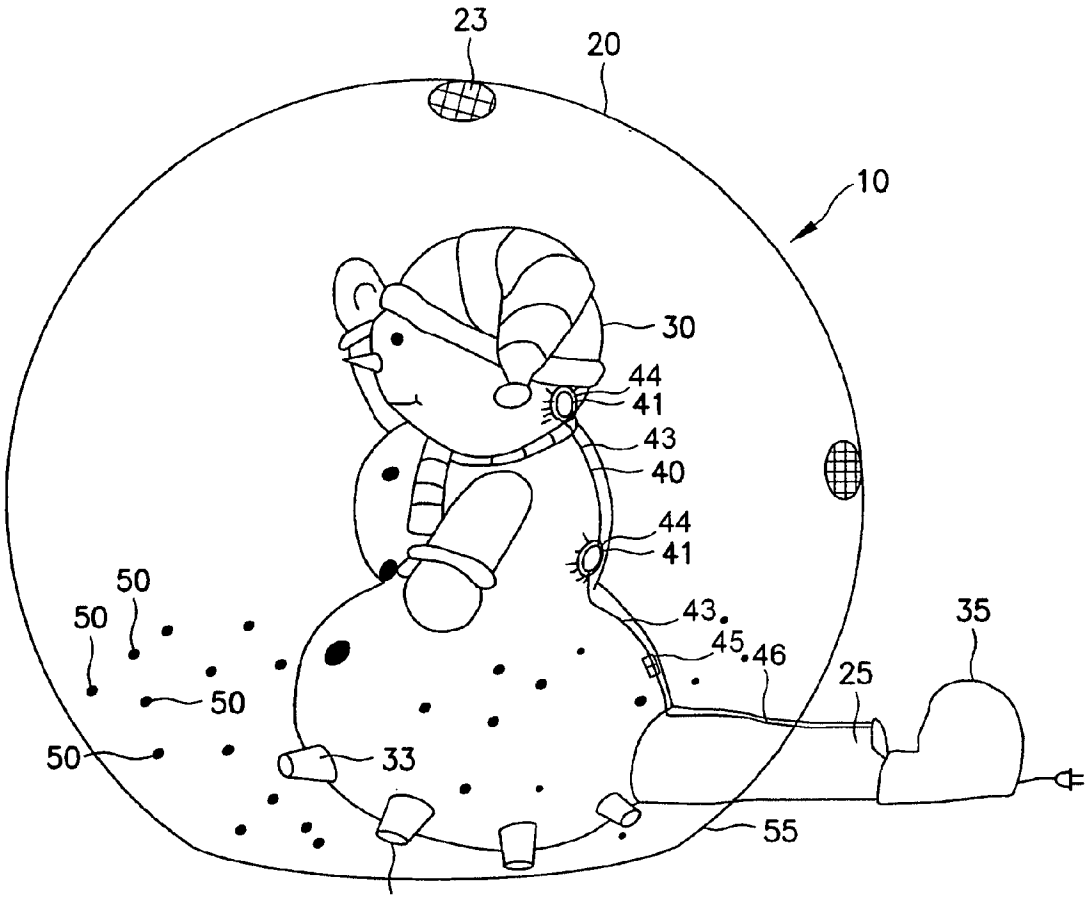
FIG. 1 is a side view of an embodiment of the present invention illustrating a snowman as the first inflation module enclosed within a transparent plastic material creating a second inflation portion.
Figures 3A, 3B, 3C, 3D, 3E:
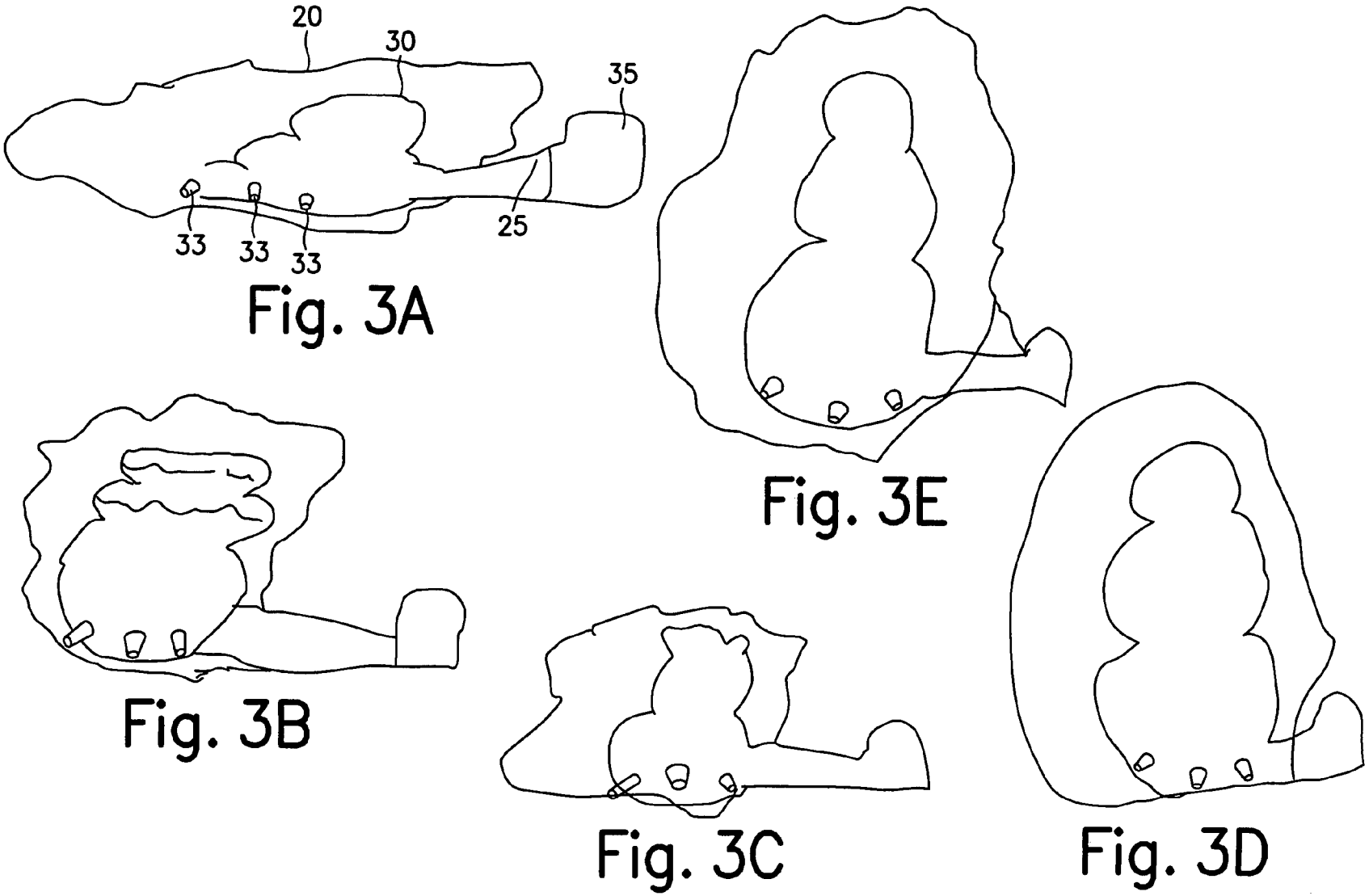
FIGS. 3A-3E are a series of views illustrating the inflation process according to an embodiment of the invention.

As illustrated as reference character 50 in FIG. 1, "snowflake" particles may be formed as polystyrene particles, or a number of other light compact polymers. Polystyrene is discussed as a preferred embodiment because it is easily produced and readily available. More specifically, polystyrene is a strong plastic created from erethylene and benzene that can be injection molded, extruded or blow molded into any number of shapes and sizes. By way of example only, FIG. 2 illustrates three exemplary embodiments of the polystyrene implemented to represent the snowflakes.

However, it is to be understood that a wide variety of shapes/sizes of particles may be utilized corresponding to the holiday and/or seasonal display and based on design characteristics that include the size of the enclosure and/or the size/shape and configuration of the first inflation module or the size and power characteristics of the fan element in a given implementation. For example as shown in FIG. 2, in order to maximize the visual effect, packing peanuts 51 (the well-known filler used to fill and protect packages from being damaged during shipping) which are large oblong shaped pieces of polystyrene may be used. Alternatively, a smaller scale implementation may use hollow semi-spherical shaped polystyrene pieces 52 or even simple polystyrene pellets 53. The embodiments discussed herein are illustrative of possible implementations and a wide variety of shapes and sizes of polystyrene particles, or any other type of compact light particle may be implemented to represent very light particles, such as "snowflakes" 50.

As illustrated in FIG. 1, fan element 35 is preferably implemented as a lightweight plastic sleeveless bearing fan. The lightweight of the electric fan assembly and the plastic housing enables the fan assembly to be secured to the fabric of the inflatable display at a position elevated above the surface-touching bottom of the display without distorting the shape of inflatable display 10. Moreover, such an assembly inflates device 10 without the need for a base to support and elevate the fan above the ground to achieve sufficient air intake. Advantageously, fan element 35 can be easily removed from its respective housing for cleaning or replacement whenever necessary. Fan element 35 is covered with a safety grill to guard against unwanted debris from entering the display as well as contacting fan blades. Further, it is possible for fan element 35 to be configured with a variable air speed control, which provides a consumer the ability to adjust the degree of snowflake agitation. Also, depending on the actual implementation, the fan element may be configured with a stand that raises the fan element off of the ground.

Furthermore, as illustrated in FIG. 1, inflatable display 10 includes second inflation module 20 that creates a transparent enclosure around first inflation module 30. As shown, second inflation module 20 forms a transparent hollow sphere with an aperture allowing air intake tube 25 to connect first inflation module 30 with fan element 35. Second inflation module 20 is formed with at least one exhaust port 23. As illustrated in FIG. 1, exhaust port 23 is formed as a circular mesh screen. In order to prevent rain from entering enclosure 20, while maintaining the position of mesh screen 23, an air duct may be attached to the exterior side of mesh screen 23 at the top of the enclosure. The functionality of exhaust port 23 will be discussed in greater detail below with regard to FIG. 4. It is to be understood that depending on the actual implementation, the size, shape, configuration and number of exhaust ports 23 formed in the surface of second inflation module 20 may vary based on characteristics such as size of the second inflation module, the flow rate of air blown into inflatable device 10 by fan element 35, or any other number of design considerations.

Similarly, first inflation module 30 also has at least one exhaust port 33. As shown in FIG. 1, exhaust port 33 is formed in the base of first inflation module 30 to both agitate particles 50, as well as inflate second inflation module 20. Exhaust port 33 may be fitted with a screen in order to keep particles 50 from entering first inflation module 30. It is to be understood that the size, shape, configuration, and placement on the surface of first inflation module 30 may vary between implementations.

FIGS. 3A-3E illustrate the process of inflating inflatable device 10. As discussed above, fan element 35 forces air through air intake tube 25 into first inflation module 30. Because first inflation module 30 is made from a permeable material, air may leak from first inflation module 30 into second inflation module 20. Furthermore, first inflation module 30 is configured with at least one exhaust port 33 formed near the base of the module (FIGS. 3A-3E illustrate an exemplary embodiment of the invention implementing three exhaust ports), wherein exhaust port 33 directs a portion of the air from intake tube 25 directly into second inflation module 20.

Figure 4:
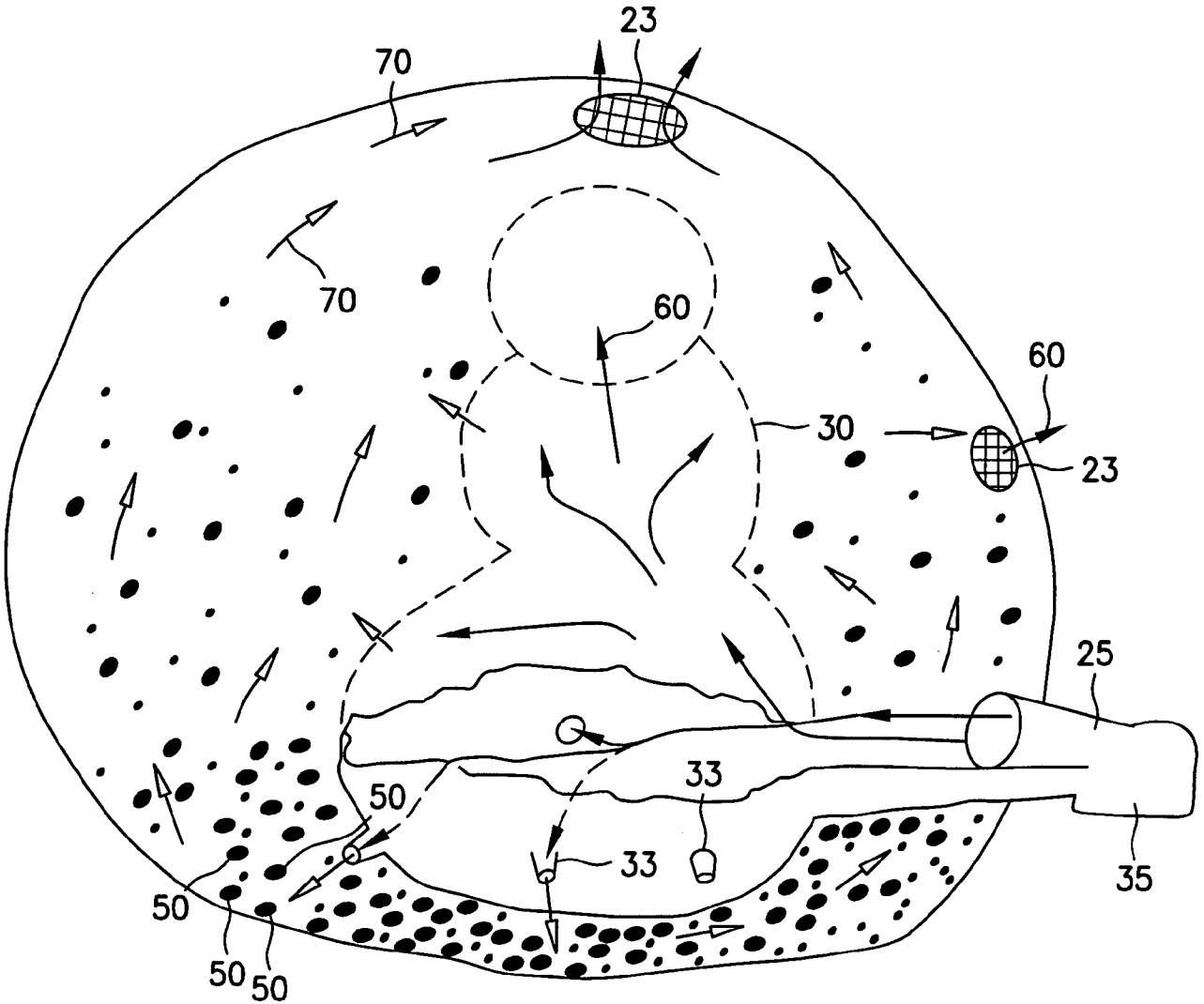
FIG. 4 is an embodiment of the invention illustrating air flow progression from a fan element introducing air into the inflatable device to the air escaping from the inflatable device through a mesh screen formed in the enclosure.

FIG. 4 illustrates an air flow progression from a point in time wherein a fan element introduces air into the inflation device to a point in time wherein the air escapes through an exhaust valve formed in the enclosure according to an embodiment of the invention. For the purpose of illustration, the arrows with solid arrowheads 60 represent airflows either within first inflation module 30 or outside second inflation module 20, whereas arrows with hollow arrowheads 70 represent airflows within enclosure 20, but outside first inflation module 30.

Air is introduced from fan element 35, through air intake tube 25 and into first inflation module 30. The air enters second inflation module 20 primarily through exhaust port 33, but also to a lesser extent though the permeable surface of first inflation module 30. Although particles 50 are made of a light material, they are heavier than air and therefore accumulate around the base of the exterior of first inflation module 30. Accordingly, by configuring exhaust ports 33 around the base of the first inflation module, particles 50 are easily agitated by air exiting exhaust port 33.

Furthermore, second inflation module 20 has at least one mesh screen 23 formed at the top and/or the back of the enclosure. As discussed above, the second inflation module is formed from a non-permeable material. Accordingly, mesh screen 23 and exhaust port 33 act to create air flows within the enclosure. These airflows agitate the polystyrene particles that have accumulated around the base of enclosure 20 and guide them toward the top of the enclosure, where the particles subsequently fall back toward the base. The continuous airflow agitation/guiding process creates an effect that generates the impression of a snowfall to an observer watching inflated device 10 in operation.

Figure 5:
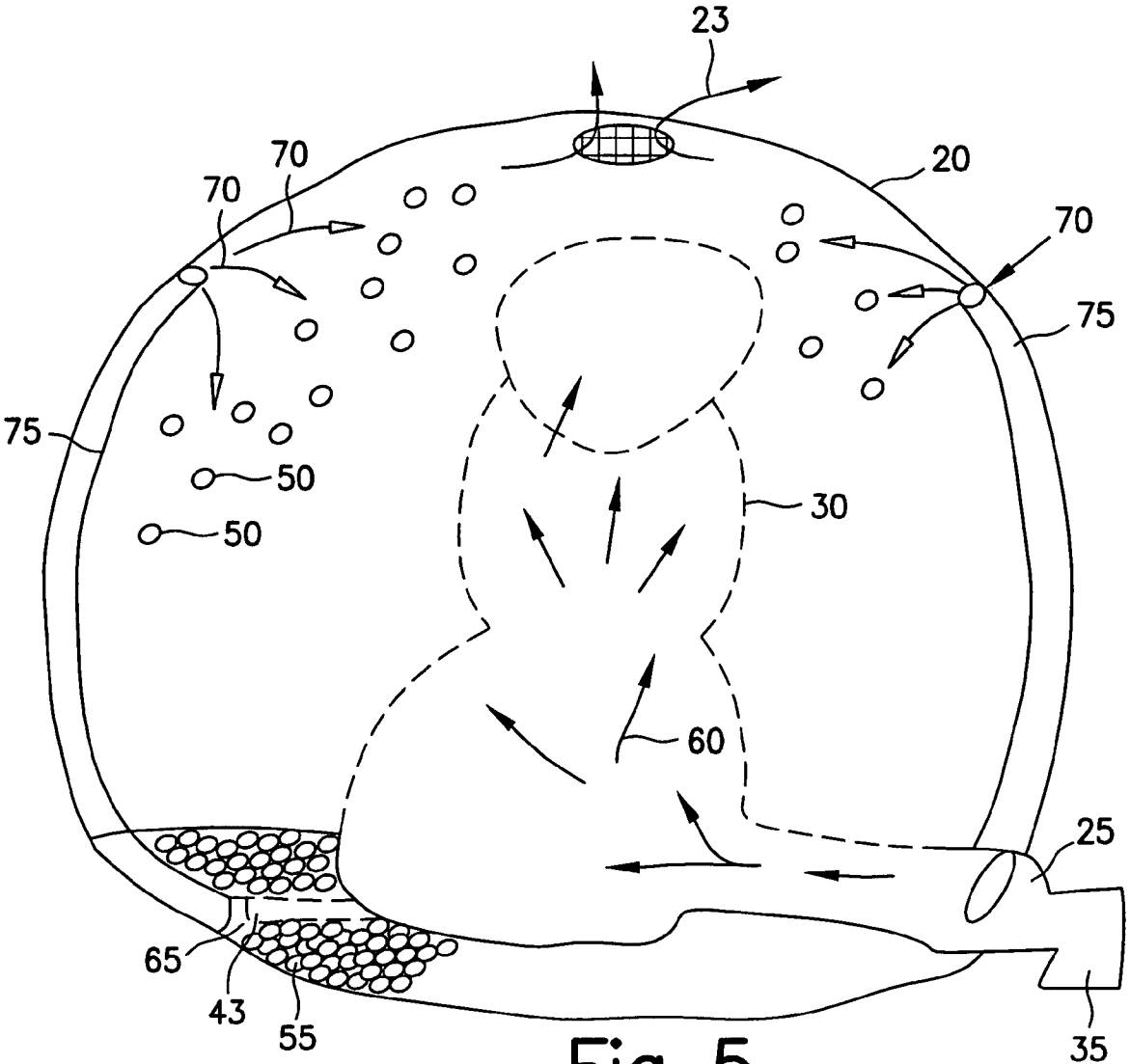
FIG. 5 illustrates another embodiment of the invention illustrating an air flow progression from a fan element introducing air into the inflatable device to air escaping the inflatable device through a mesh screen formed in the enclosure.

FIG. 5 illustrates an air flow progression within a second embodiment of the invention wherein exhaust ports 33 formed in the base of first inflation module 30 are replaced with vacuum agitation ports 43. Air is introduced into the inflatable device via fan element 35 and air duct 25. The air inflates first inflation module 30 and then continues into a vacuum agitation port 43. The vacuum agitation port 43 directs the air flow into particle reservoir 55. Particle reservoir 55 collects particles after they have been agitated, as well as feeds agitation guide 75. Vacuum port 43 works in coordination with agitation guide 75 to bring the particles from particle reservoir 55 to the top of second inflation module 20 to dispersal point 70.

Although illustrative preferred embodiments have been described herein in detail, it should be noted and will be appreciated by those skilled in the art that numerous variations may be made within the scope of this invention without departing from the principle of this invention and without sacrificing its chief advantages. The terms and expressions have been used as terms of description and not terms of limitation. There is no intention to use the terms or expressions to exclude any equivalents of features shown and described or portions thereof and this invention should be defined in accordance with the claims which follow.

The invention claimed is:

1. An inflatable display comprising:

a first inflation module consisting of a permeable fabric, wherein the first inflation module includes at least one exhaust port;

a second inflation module, wherein the second inflation module is transparent;

a fan element, operatively connected to the first inflation module;

a plurality of particles stored inside the second inflation module, but outside the first inflation module;

wherein the fan element is configured to provide a continuous air flow to inflate the first inflation module and inflate the second inflation module through the at least one exhaust port of the first inflation module.

2. The inflatable display of claim 1, wherein the first inflation module agitates the particles within the second inflation module through the at least one exhaust port of the first inflation module.

3. The inflatable display of claim 2, wherein the second inflation module includes an exterior exhaust port.

4. The inflatable display of claim 3, wherein the at least one exhaust port of the first inflation module includes a mesh cover to prevent a backflow of particles into the interior of the first inflation module.

5. The inflatable display of claim 4, wherein the first inflation module consisting of a permeable fabric is configured to assist in inflating the second inflation module.

6. The inflatable display of claim 3, wherein the first inflation module includes a vacuum agitation port.

7. The inflatable display of claim 6, wherein the second inflation module is configured with an agitation guide.

8. The inflatable display of claim 7, wherein the agitation guide works in coordination with the vacuum agitation port to bring the particles from a particle reservoir to a top portion of the second inflatable module.

9. The inflatable display of claim 8, wherein the first inflation module consisting of a permeable fabric is configured to assist in inflating the second inflation module.

10. The inflatable display of claim 1, further comprising a lighting apparatus disposed within the first inflation module.

11. The inflatable display of claim 10, wherein the lighting apparatus comprises:

a first power cord, at least one light fixture, including a light bulb with a protective cover, secured to one end of said first power cord and an electrical connector disposed at the other end of said first power cord; and a second power cord extending from said electrical connector connecting with said fan element.

12. The inflatable display of claim 1, wherein said fan element is connected to the first inflation module through an air intake tube.

13. The inflatable display of claim 1, wherein said at least one exhaust port of the first inflation module is formed in the base of the first inflation module.

14. An inflatable display comprising:

a first inflation module consisting of a permeable fabric disposed inside a second inflation module, wherein the first inflation module includes at least one exhaust port and wherein the second inflation module is transparent;

a fan element, operatively connected to the first inflation module;

a plurality of particles stored inside the second inflation module, but outside the first inflation module;

wherein the fan element is configured to provide a continuous air flow to inflate the first inflation module and inflate the second inflation module through the at least one exhaust port of the first inflation module.

15. An inflatable display comprising:

multiple inflation modules consisting of permeable fabric disposed inside a transparent inflation module, wherein at least one of the multiple inflation modules includes at least one exhaust port;

a fan element operatively connected to inflate each of said multiple inflation modules;

a plurality of particles stored inside said transparent inflation module, but outside the multiple inflation modules;

wherein the fan element is configured to provide a continuous air flow to inflate each of said multiple inflation modules and inflate the transparent inflation module through the at least one exhaust port.

16. The inflatable display of claim 15, further comprising a lighting apparatus disposed within the multiple inflation modules.

17. The inflatable display of claim 16, wherein the lighting apparatus comprises:

a first power cord, at least one light fixture, including a light bulb with a protective cover, secured to one end of said first power cord and an electrical connector disposed at the other end of said first power cord; and a second power cord extending from said electrical connector connecting with said fan element.

18. The inflatable display of claim 15, wherein said fan element is connected to the multiple inflation modules through an air intake tube.

19. The inflatable display of claim 15, wherein said at least one exhaust port of the first inflation module is formed in the base of the multiple inflation modules.

20. The inflatable display of claim 14, further comprising a lighting apparatus disposed within the first inflation module.

21. The inflatable display of claim 20, wherein the lighting apparatus comprises:

a first power cord, at least one light fixture, including a light bulb with a protective cover, secured to one end of said first power cord and an electrical connector disposed at the other end of said first power cord; and a second power cord extending from said electrical connector connecting with said fan element.

22. The inflatable display of claim 14, wherein said fan element is connected to the first inflation module through an air intake tube.

23. The inflatable display of claim 14, wherein said at least one exhaust port of the first inflation module is formed in the base of the first inflation module.

24. A method for inflating an inflatable display comprising:

inflating a first inflation module consisting of a permeable fabric disposed inside a second inflation module, wherein the second inflation module is transparent; and providing a continuous air flow to inflate the second inflation module through at least one exhaust port of the first inflation module; and agitating particles disposed between the first and second inflation modules through the at least one exhaust port of the first inflation module.

25. The method for inflating an inflatable display of claim 24, further comprising illuminating the inflatable display with a lighting apparatus disposed within the first inflation module.

* * * * *